US011525272B2

(12) United States Patent
Lee

(10) Patent No.: US 11,525,272 B2
(45) Date of Patent: Dec. 13, 2022

(54) ANTI-SEISMIC PERFORMANCE REINFORCEMENT AND CRACK REPAIR STRUCTURE OF MASONRY STRUCTURE AND CONSTRUCTION METHOD OF SAME

(71) Applicant: MOJEON INDUSTRIAL. CO., LTD., Gyeonggi-do (KR)

(72) Inventor: Yan Sup Lee, Seoul (KR)

(73) Assignee: MOJEON INDUSTRIAL. CO., LTD., Gyeonggi-Do (KR)

( * ) Notice: Subject to any disclaimer, the term of this patent is extended or adjusted under 35 U.S.C. 154(b) by 243 days.

(21) Appl. No.: 16/993,679

(22) Filed: Aug. 14, 2020

(65) Prior Publication Data

US 2021/0062523 A1 Mar. 4, 2021

(30) Foreign Application Priority Data

Sep. 4, 2019 (KR) ..... 10-2019-0109372

(51) Int. Cl.
*E04G 23/02* (2006.01)
*E04H 9/02* (2006.01)

(52) U.S. Cl.
CPC ..... *E04G 23/0244* (2013.01); *E04H 9/027* (2013.01)

(58) Field of Classification Search
CPC ..... E04H 9/02; E04H 9/027; E04G 23/0218; E04G 23/0222; E04G 23/0244; E04G 23/0296
See application file for complete search history.

(56) References Cited

U.S. PATENT DOCUMENTS 7,568,320 B2 * 8/2009 Paterson ..... E04B 1/4178 52/282.4
8,555,587 B2 * 10/2013 Hohmann, Jr. ..... E04G 23/0222 52/391
2005/0097849 A1 * 5/2005 Hayes ..... E04C 5/07 52/698

(Continued)

FOREIGN PATENT DOCUMENTS

CN 107989401 A * 5/2018 ..... E04B 1/4178
CN 110185276 A * 8/2019
CN 209509559 U * 10/2019

(Continued)

*Primary Examiner* — Ryan D Kwiecinski
(74) *Attorney, Agent, or Firm* — IPLA P.A.

(57) ABSTRACT

An anti-seismic performance reinforcement structure of a masonry structure and a construction method of the same are proposed, where a deformed bar is constructed to be tied to the entire circumference of the masonry structure at every predetermined height thereof such that the masonry structure is connected to a wall, thereby simplifying a construction process, and inducing the masonry structure and the wall to be moved integrally to each other during an earthquake so as to prevent the masonry wall from collapsing. The method of performing anti-seismic performance reinforcement and crack repair of the masonry structure includes: removing a predetermined depth of a horizontal joint; mounting the cross joint by forcibly press-fitting the cross joint having the press-in holder and the horizontal holder to a perforated position; fixing a deformed bar fixture to the wall; and tying the entire circumference of the masonry structure with the deformed bar.

6 Claims, 20 Drawing Sheets

(56) References Cited

U.S. PATENT DOCUMENTS

2021/0062523 A1* 3/2021 Lee ..... E04H 9/027

FOREIGN PATENT DOCUMENTS

| | | | | | |
|---|---|---|---|---|---|
| CN | 112096113 | A | * | 12/2020 | |
| GB | 2397831 | A | * | 8/2004 | ..... E04B 1/4178 |
| KR | 20130123138 | | | 11/2013 | |
| KR | 2019001087 | A | * | 1/2019 | ..... E04B 1/4178 |
| WO | WO-2010002049 | A1 | * | 1/2010 | ..... E04C 5/165 |

* cited by examiner

ANTI-SEISMIC PERFORMANCE REINFORCEMENT AND CRACK REPAIR STRUCTURE OF MASONRY STRUCTURE AND CONSTRUCTION METHOD OF SAME

CROSS REFERENCE

The present application claims priority to Korean Patent Application No. 10-2019-0109372, filed Sep. 4, 2019, the entire contents of which is incorporated herein for all purposes by this reference.

BACKGROUND

The present invention generally relates to an anti-seismic performance reinforcement structure of a masonry structure and a construction method of the same. More particularly, the present invention relates to an anti-seismic performance reinforcement and crack repair structure of a masonry structure and a construction method of the same, wherein a deformed bar is constructed to be tied to the entire circumference of the masonry structure at every predetermined height thereof such that the masonry structure is connected to a wall, thereby simplifying a construction process, and inducing the masonry structure and the wall to be moved integrally to each other during an earthquake so as to prevent the masonry structure from collapsing.

Generally, a masonry structure is a masonry wall made by stacking bricks and concrete blocks on the outside of a wall (an inner wall). A bonding force between inner and outer walls is very important such that the masonry wall has an anti-seismic performance. Due to the characteristics of the configuration of the masonry wall, which is constructed by stacking bricks one by one, the masonry wall is very vulnerable to lateral loads without means to secure integrity such as edge beams, and may collapse. The collapsing (out-of-plane deformation) of the masonry wall is the most fatal phenomenon that occurs in a masonry building due to an earthquake. In the out-of-plane deformation, a force acts in a vertical direction rather than a wall direction so that the masonry wall collapses. The out-of-plane deformation is a deformation which the masonry wall vulnerable to bending stress (tensile force) is difficult to resist, and causes the rapid collapse of an entire structure. To prevent such a collapse, the consideration of the prevention of the collapse is required from the time of planning the masonry building.

As a related art of the present invention, "reinforcement structure of masonry wall" is proposed in Korean Patent No. 10-1371098. This is a simple construction using fixing members and deformed bars, and increases the bondability of the masonry wall composed of the inner wall, a heat insulating material, and the outer wall such that the life and rigidity of the masonry wall are increased. However, the related art has the disadvantage that an installation process is lengthened by the increase of the number of parts required, such as the deformed bars installed vertically, additional deformed bars installed horizontally, the fixing members, and fixtures.

DOCUMENT OF RELATED ART (Patent Document 1) Korean Patent No. 10-1371098

SUMMARY OF THE INVENTION

Accordingly, the present invention has been made keeping in mind the above problems occurring in the related art, and the present invention is intended to propose an anti-seismic performance reinforcement structure of a masonry structure and a construction method of the same, wherein a deformed bar is constructed to be tied to the entire circumference of the masonry structure at every predetermined height thereof such that the masonry structure is connected to a wall, thereby simplifying a construction process, and inducing the masonry structure and the wall to be moved integrally to each other during an earthquake so as to prevent the masonry structure from collapsing.

In order to achieve the above objective, according to one aspect of the present invention, there is provided a method of performing anti-seismic performance reinforcement and crack repair of a masonry structure, the method of performing the anti-seismic performance reinforcement of the masonry structure stacked with masonry bricks on an outside of a wall, the method including: removing a predetermined depth of a horizontal joint along an entire circumference of the masonry structure by selecting the horizontal joint at every predetermined height on an outer surface of the masonry structure; mounting deformed bars such that the deformed bars are in contact with the horizontal joint by forcibly fitting a press-in holder to a perforated position while the deformed bars are coupled to the horizontal holder of a cross joint after perforating a vertical joint by selecting the vertical joint being in contact with the horizontal joint every predetermined interval along the horizontal joint; fixing a deformed bar fixture to the wall by driving the deformed bar fixture thereto after inserting and coupling the deformed bar fixture to the press-in holder of the cross joint; and tying the entire circumference of the masonry structure after surrounding the entire circumference with the deformed bars by allowing the deformed bars neighboring to each other to be connected to a binding holder every repetition of the mounting and the fixing.

In addition, the method may further include: first mounting middle fixtures fixed to the wall to the masonry bricks by allowing the middle fixtures to penetrate the masonry bricks in an area between deformed bars vertically neighboring to each other before the removing.

Furthermore, when middle fixtures vertically neighboring to each other and horizontal deformed bar fixtures located to be adjacent to each other between the middle fixtures are connected to each other by an imaginary line, the middle fixtures and the deformed bar fixtures may be constructed to define a rhombus arrangement.

Additionally, in the fixing, the deformed bar fixture may have two to six spiral wing angles on an outer circumferential surface thereof; the press-in holder of the cross joint may have six spiral grooves in an inner circumferential surface thereof, the spiral grooves receiving the spiral wing angles provided on the outer circumferential surface of the deformed bar fixture; and the horizontal holder may have six spiral grooves in an inner circumferential surface thereof.

In addition, in the fixing, a gap between the press-in holder and the deformed bar fixture may be filled with silicon.

Furthermore, wherein in the tying, after silicon is coated on a back surface of each of the deformed bars in the horizontal joint to which the deformed bar is mounted, non-shrink mortar may be filled thereon to perform a finishing work.

Meanwhile, an anti-seismic performance reinforcement structure of the masonry structure according to the present invention, the structure for the anti-seismic performance reinforcement of the masonry structure stacked with masonry bricks on the outside of the wall, the structure including: the cross joints press-fitted into perforated holes located at predetermined intervals along the entire circumference of the masonry structure every predetermined height on the outer surface thereof; the deformed bar fixture coupled to the press-in holder of each of the cross joints to be fixed to the wall; and the deformed bar coupled to the horizontal holder of the cross joint to tie the entire circumference of the masonry structure every corresponding height.

In addition, after the horizontal joint having a surface layer of a portion thereof removed is selected and the deformed bar is disposed in the horizontal joint, silicon and non-shrink mortar may be sequentially filled on the back surface of the deformed bar.

Furthermore, the gap between the press-in holder and the deformed bar fixture may be filled with silicon.

Additionally, the masonry bricks may be selected between deformed bars vertically neighboring to each other, and the middle fixtures fixed to the wall may be first mounted to the masonry bricks, and when mounting points of deformed bar fixtures vertically neighboring to each other and middle fixtures horizontally neighboring to each other are connected to each other, the rhombus arrangement may be defined.

According to the anti-seismic performance reinforcement structure of a masonry structure of the present invention and the construction method of the same, wherein the removal of a portion of the horizontal joint, the mounting of the deformed bar and the cross joint, the mounting of a deformed bar fixture are sequentially performed simply, thereby decreasing a construction period.

In addition, one deformed bar connected via the binding holder is tied to the entire circumference of the masonry structure at every predetermined height thereof, thereby enabling crack repairing of a masonry wall, and inducing the masonry structure and the wall to be moved integrally to each other during an earthquake so as to prevent the masonry structure from collapsing, whereby an anti-seismic performance is improved.

BRIEF DESCRIPTION OF THE DRAWINGS

The following drawings attached in this specification are intended to illustrate an exemplary embodiment of the present invention, and serve to further make the technical idea of the present invention understood together with the detailed description of the present invention. Accordingly, the present invention should not be interpreted as being limited only to items described in the accompanying drawings.

DETAILED DESCRIPTION OF THE INVENTION

Figure 1A:
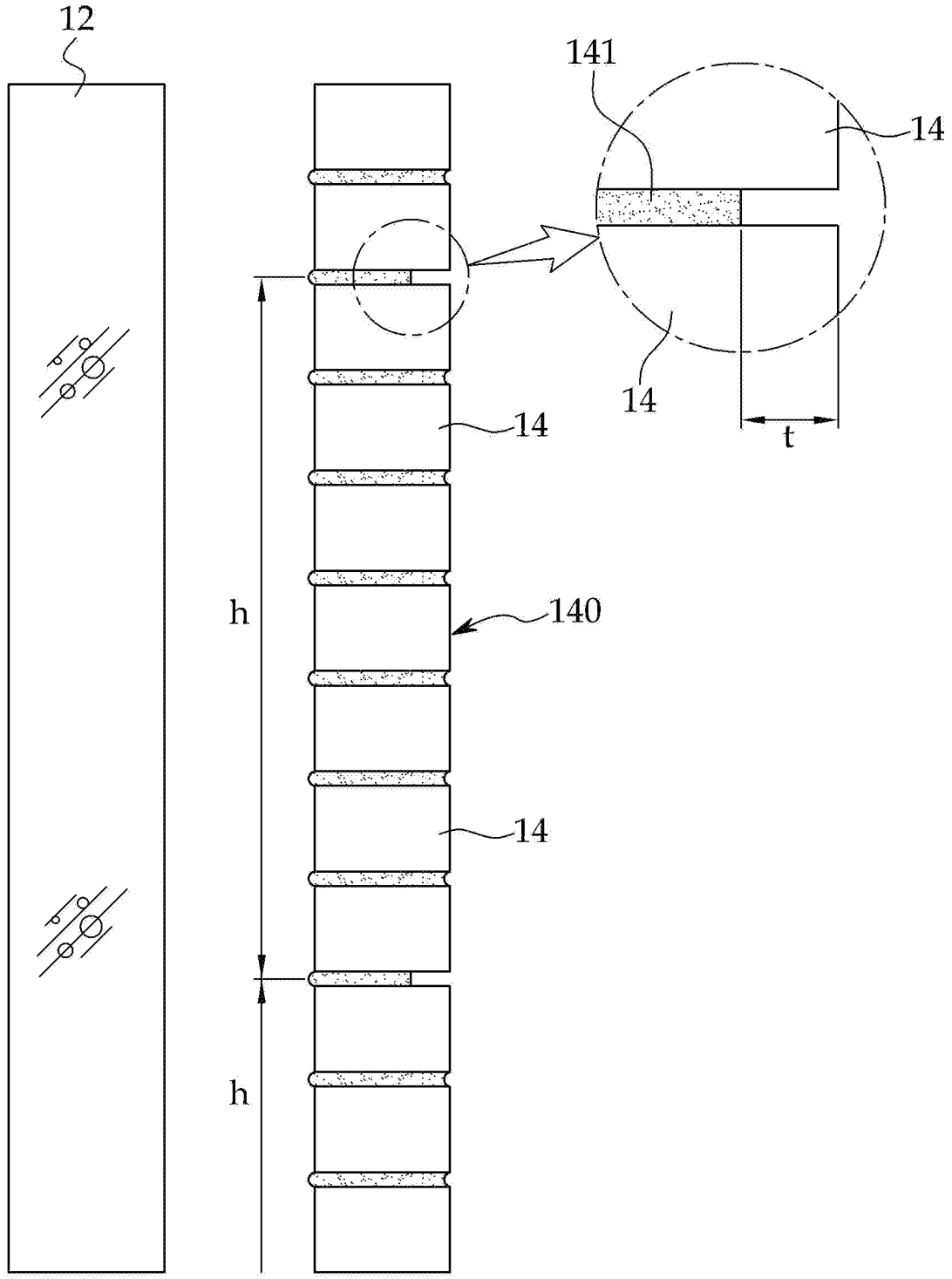
FIGS. 1A and 1B are a vertical sectional view and a top plan view, respectively, illustrating the state of the horizontal joint removed by a predetermined depth t on the masonry structure.

Hereinbelow, the present invention will be described in detail below with reference to an embodiment presented in the accompanying drawings, but the presented embodiment is illustrative for a clear understanding of the present invention and the present invention is not limited thereto.

As illustrated in FIGS. 4A, 4B, 4C, 5, and 9, in the present invention, to obtain an anti-seismic performance reinforcement performance of a masonry structure 140, a deformed bar 40 is tied to the entire circumference of the masonry structure 140 at every predetermined height thereof. In this case, the masonry structure 140 refers to a structure stacked with masonry bricks 14 on the outside of a wall 12. The wall 12 (or an inner wall) may be a concrete wall illustrated in FIG. 1A or a masonry wall illustrated in FIG. 1C.

That is, cross joints 20 are press-fitted to perforated holes at predetermined intervals every predetermined height h along the entire circumference of the masonry structure 140 on the outer surface thereof; a deformed bar fixture 30 is coupled to a press-in holder 21 of each of the cross joints 20 to be fixed to the wall 12; and the deformed bar 40 is coupled to a horizontal holder 22 of the cross joint 20 to tie the entire circumference of the masonry structure 140.

Figure 4A:
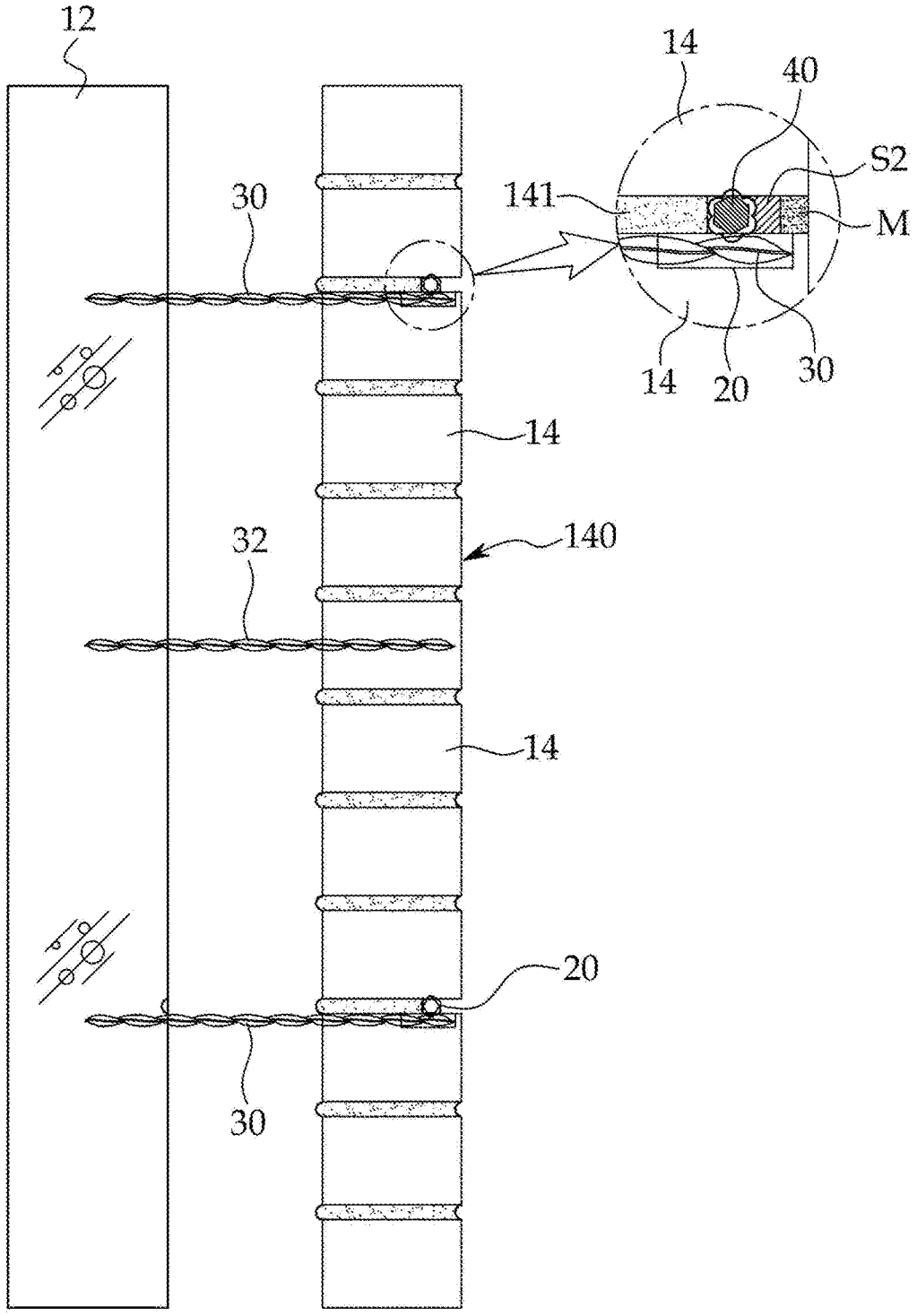
FIGS. 4A, 4B, and 4C are each a vertical sectional view, a top plan view, and a side view, respectively, illustrating the state of the entire circumference of the masonry structure tied by the deformed bar connected to the cross joint.
Figure 4B:
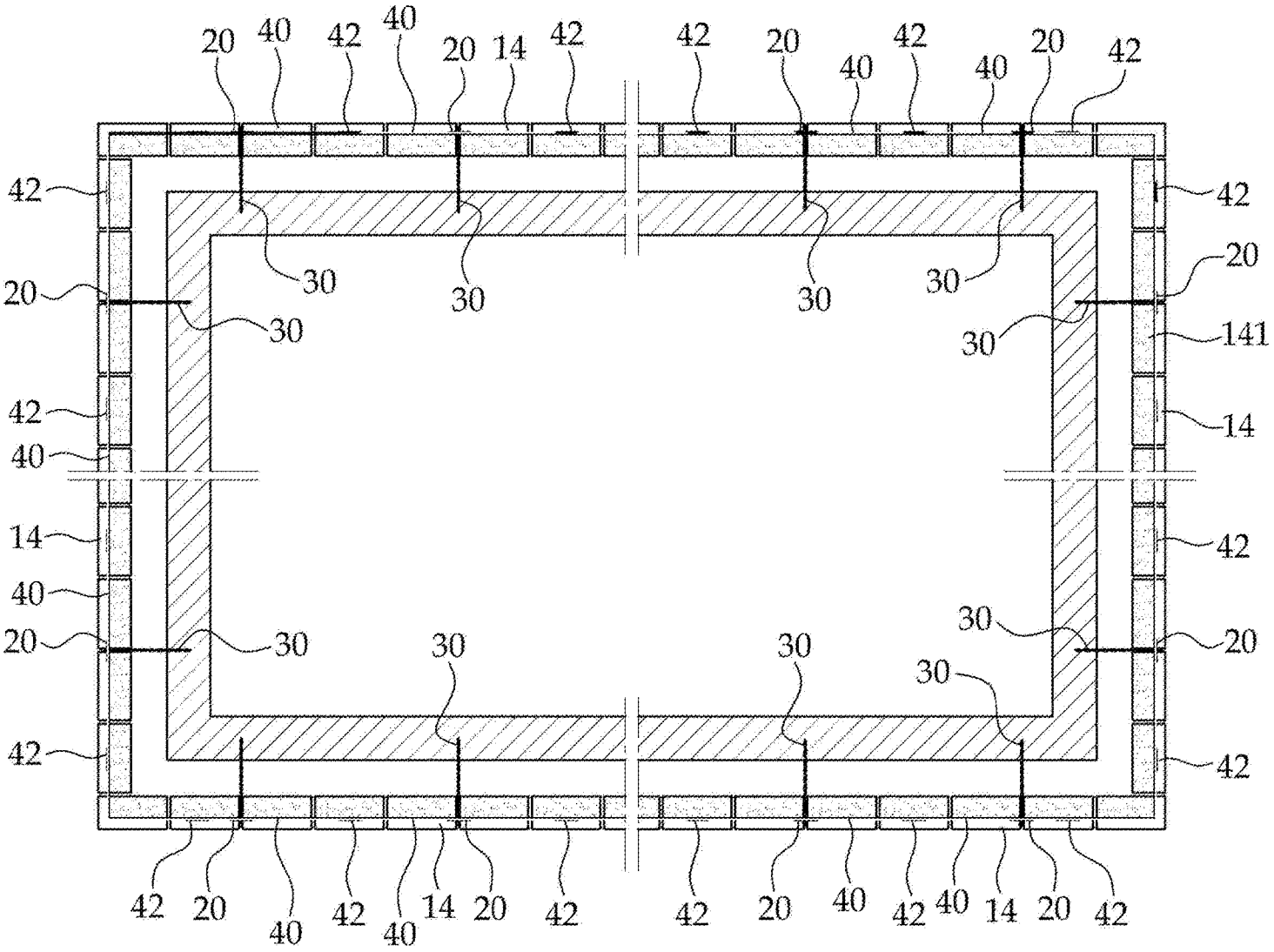
Figure 4C:
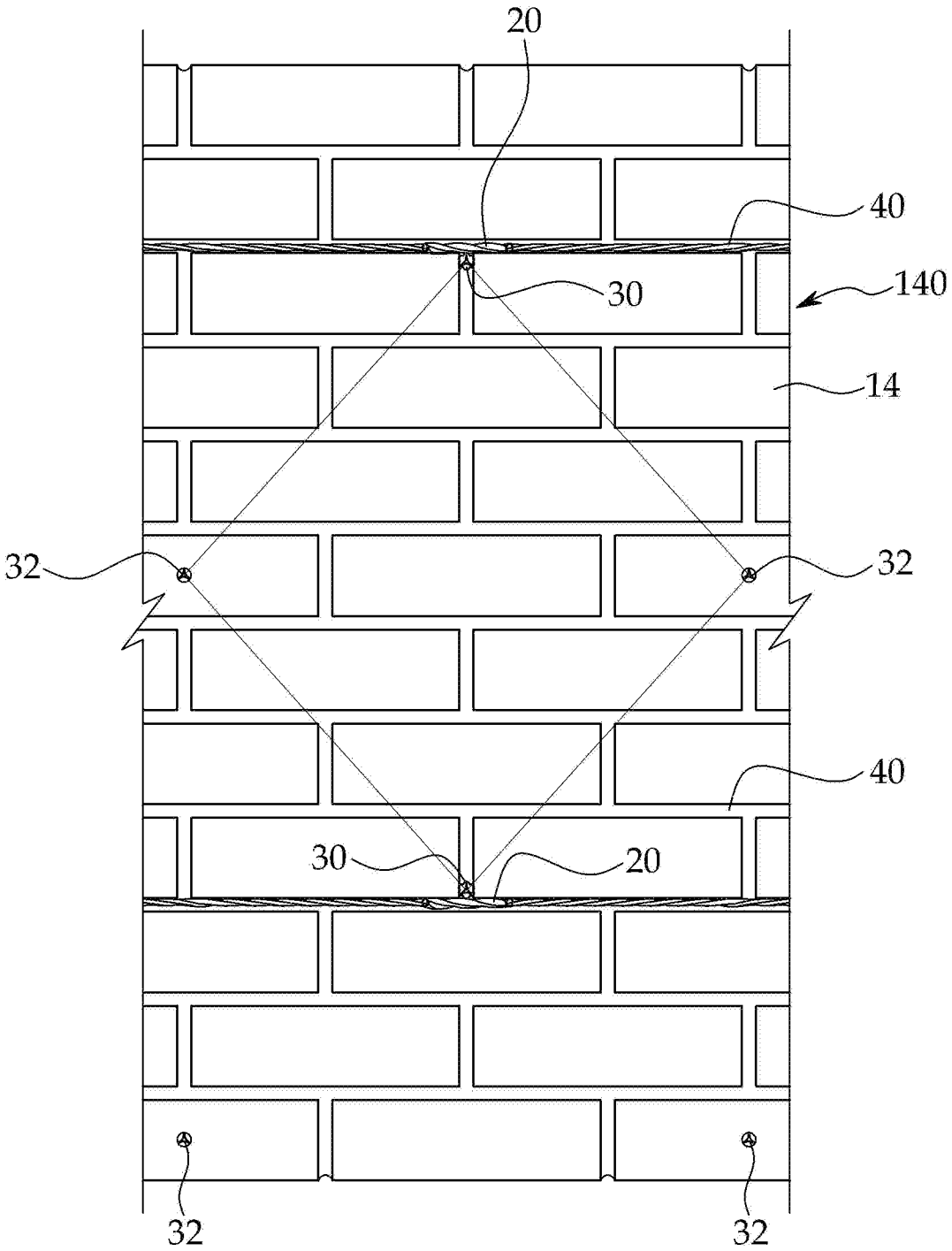

In this case, as illustrated in FIG. 4A, the deformed bar 40 may have a structure in which the deformed bar is disposed on a horizontal joint 141 having a surface layer of a portion thereof removed after the horizontal joint 141 is selected, and then silicon S2 and non-shrink mortar M are sequentially filled on the back surface of the deformed bar 40. Here, the silicon S2 can function to absorb impact during an earthquake.

Figure 7A:
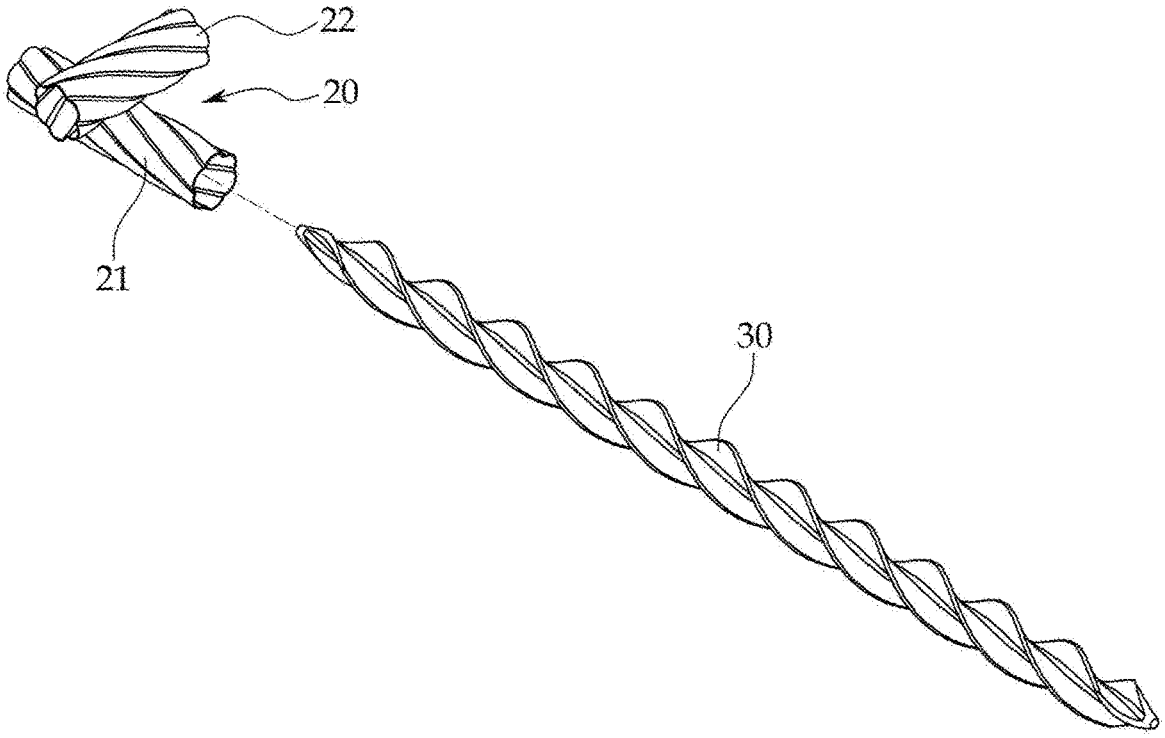
FIGS. 7A and 7B are each a perspective view before the cross joint and the deformed bar fixture applied in FIG. 2A are coupled to each other, and a perspective view after the cross joint and the deformed bar fixture are coupled to each other, respectively.
Figure 7B:
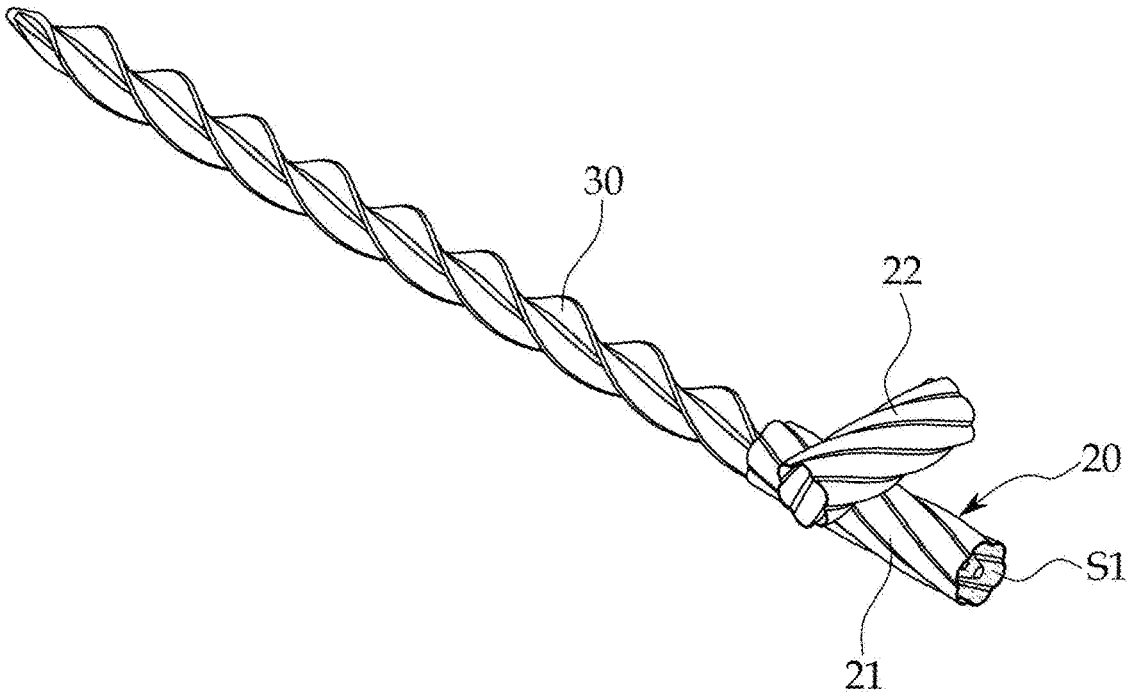

In addition, as illustrated in FIG. 7B, a gap between the press-in holder 21 and the deformed bar fixture 30 may be filled with silicon S1 for impact absorption.

Figure 5:
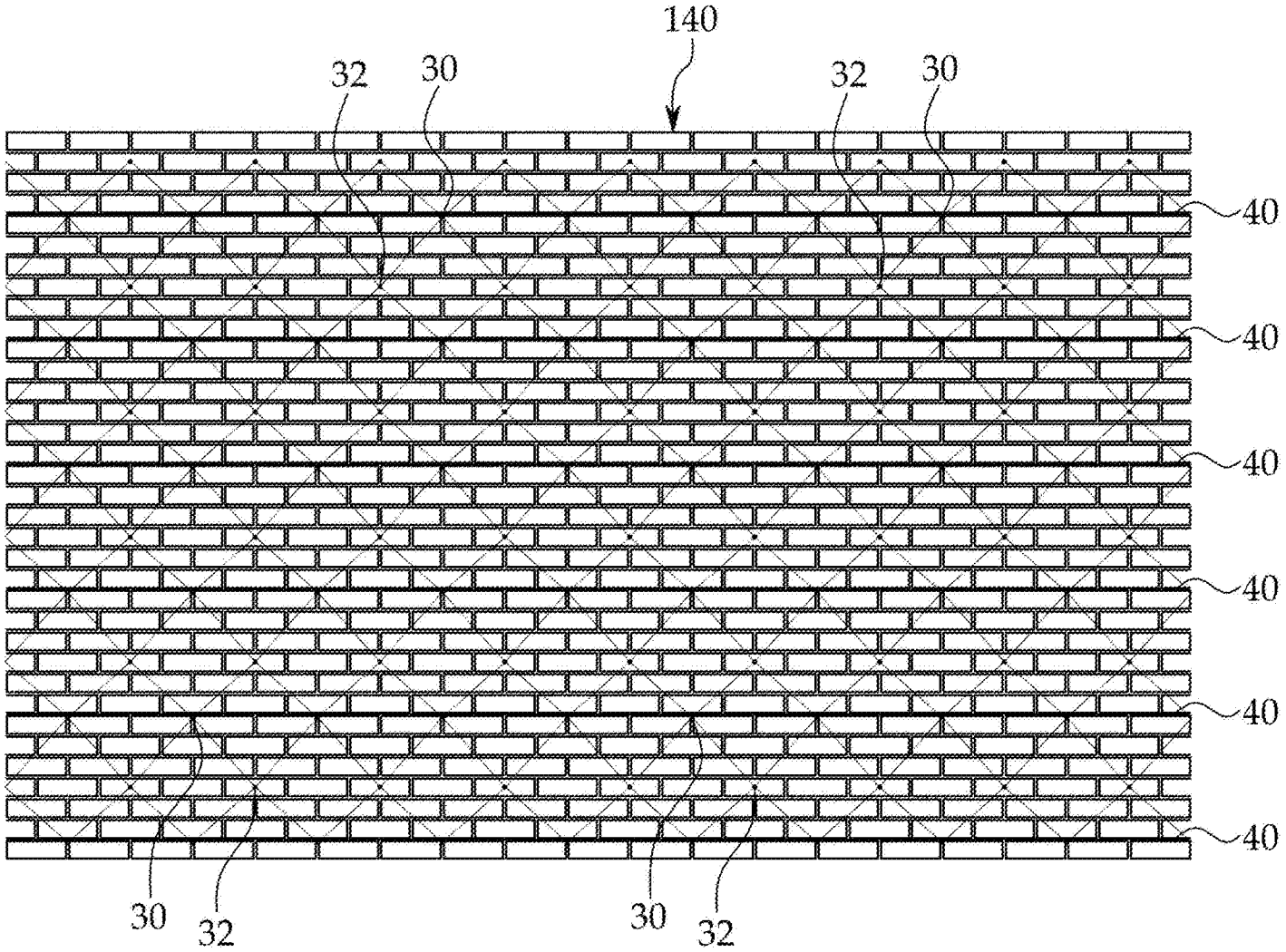
FIG. 5 is a disposed state view of middle fixtures mounted to the masonry structure of FIG. 4A.

Here, as illustrated in FIGS. 4A and 5, the masonry bricks 14 are selected between the deformed bars 40 vertically neighboring to each other, and first, middle fixtures 32 fixed to the wall 12 are preferably mounted to the masonry bricks. In this case, to have a stable anti-seismic structure as illustrated in FIG. 5, when the mounting points of the deformed bar fixtures 30 and 30 vertically neighboring to each other and the middle fixtures 32 and 32 horizontally neighboring to each other are connected to each other, the rhombus arrangement is preferably defined.

Figure 7C:
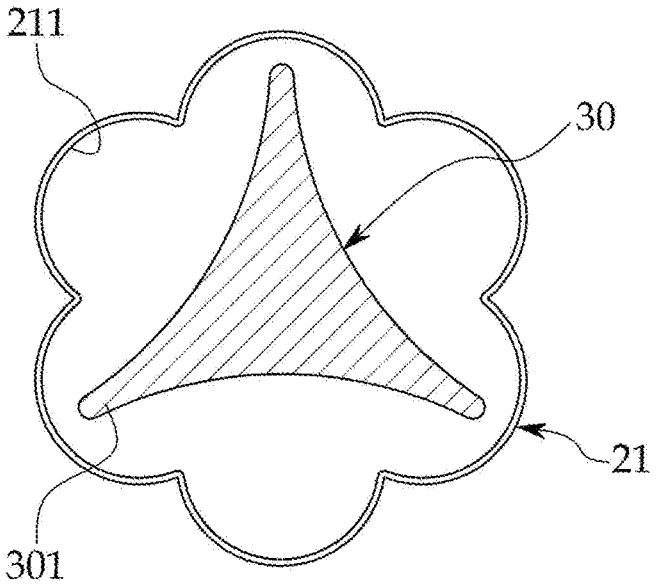
FIGS. 7C, 7D, and 7E illustrate various cross-section shapes of the deformed bar fixture illustrated in FIGS. 7A and 7B.
Figure 7D:
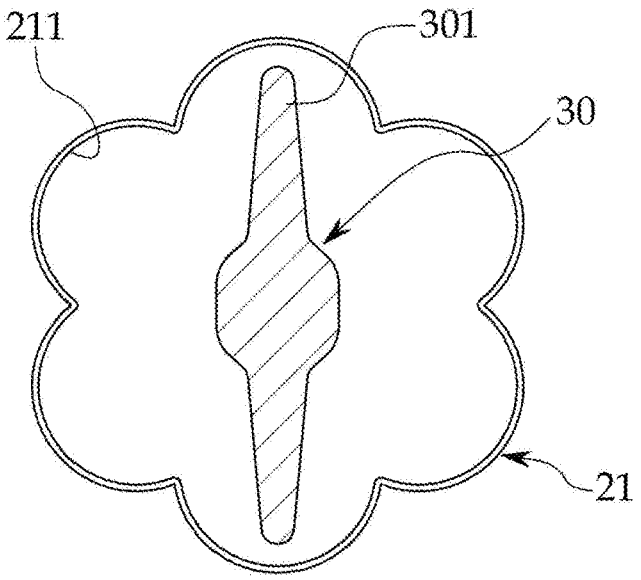
Figure 7E:
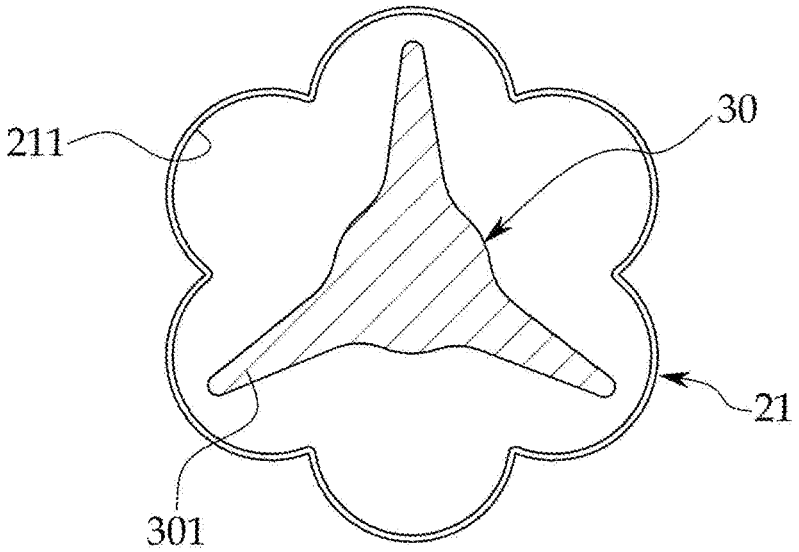

As illustrated in FIGS. 7C, 7D, and 7E, the deformed bar fixture 30 may have an approximately triangular cross-section, or have two or three spiral wing angles 301 on an outer circumferential surface thereof to rotatably penetrate the wall 12. However, although not shown, the deformed bar fixture 30 may have four to six spiral wing angles 301.

As illustrated in FIGS. 6A, 6B, 6C, and 6D, the cross joint 20 has the press-in holder 21 and the horizontal holder 22 orthogonal to each other. The press-in holder 21 has six spiral grooves 211 provided in an inner circumferential surface thereof, the spiral grooves receiving the spiral wing angles 301 provided on the outer circumferential surface of the deformed bar fixture 30, and the horizontal holder 22 has six spiral grooves 221 provided in an inner circumferential surface thereof.

Figure 10A:
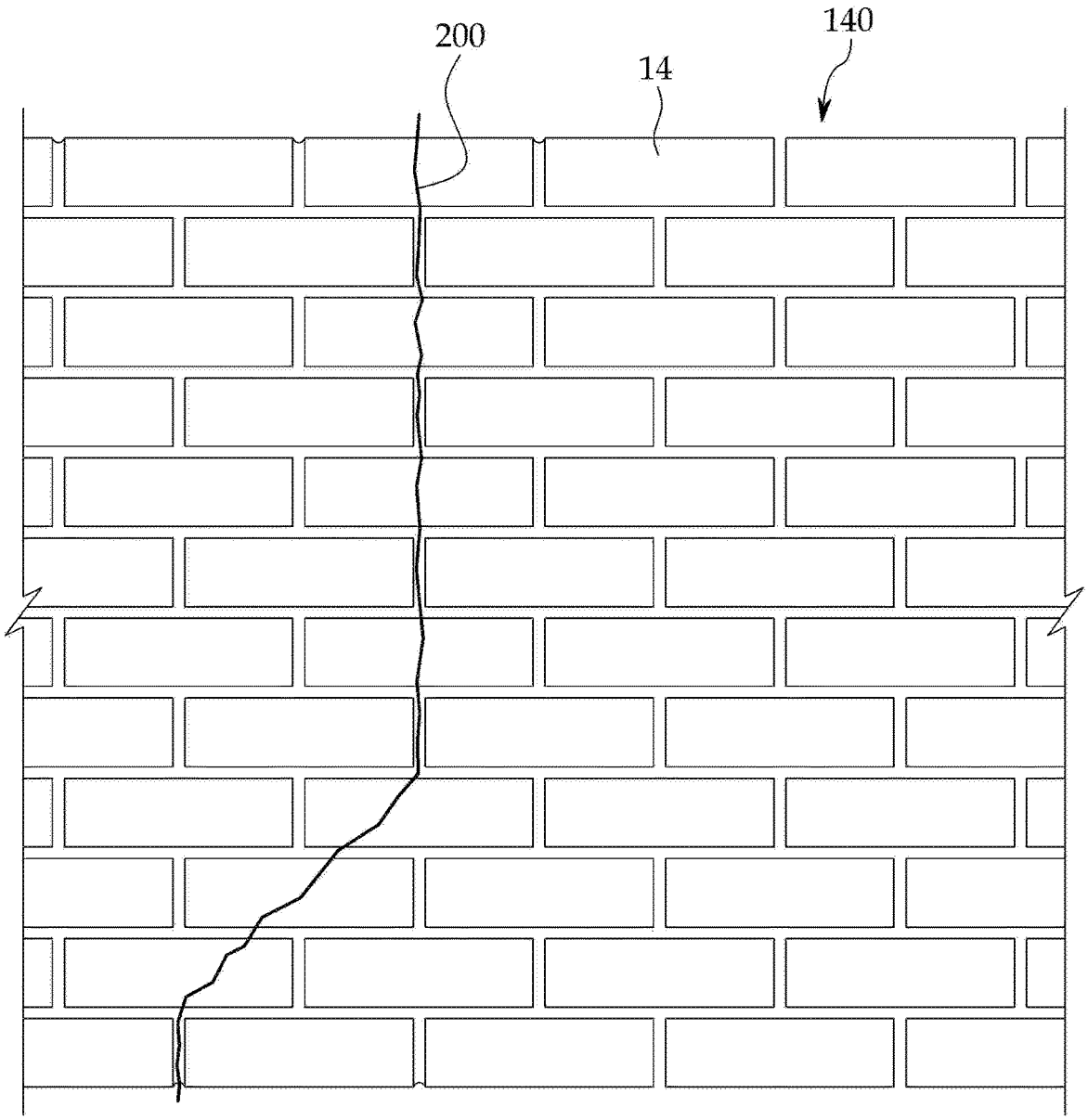
FIG. 10A illustrates the state in which crack occurs in the masonry structure.
Figure 10B:
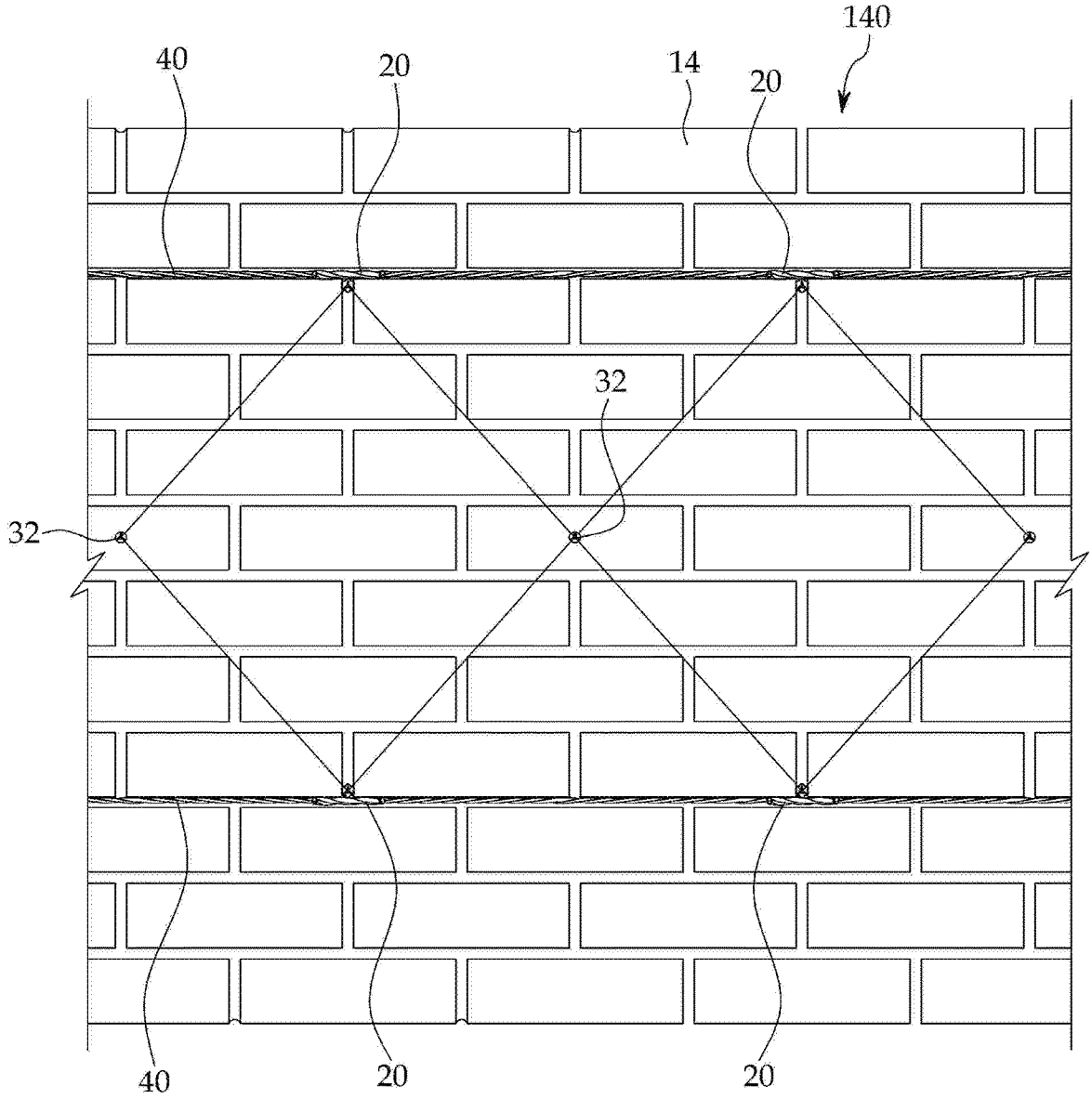
FIG. 10B is a view of the state in which the crack occurring in the masonry structure is repaired according to the embodiment of the present invention.

Accordingly, the structure according to the present invention has a structure in which the entire circumference of the masonry structure 140 is tied by the deformed bar 40 at every predetermined height thereof. Accordingly, the entirety of the masonry structure 140 is moved in the same direction together with the wall 12 during an earthquake, so a collapse is prevented, thereby improving anti-seismic stability. Furthermore, as illustrated in FIG. 10B, the masonry structure 140 in which crack 200 occurs can be repaired by being tied to the deformed bars 40.

Hereinafter, the method of performing the anti-seismic performance reinforcement and crack repair of the masonry structure 140 according to the embodiment of the present invention will be sequentially described.

The Removal of the Predetermined Depth of the Horizontal Joint 141

Figure 1B:
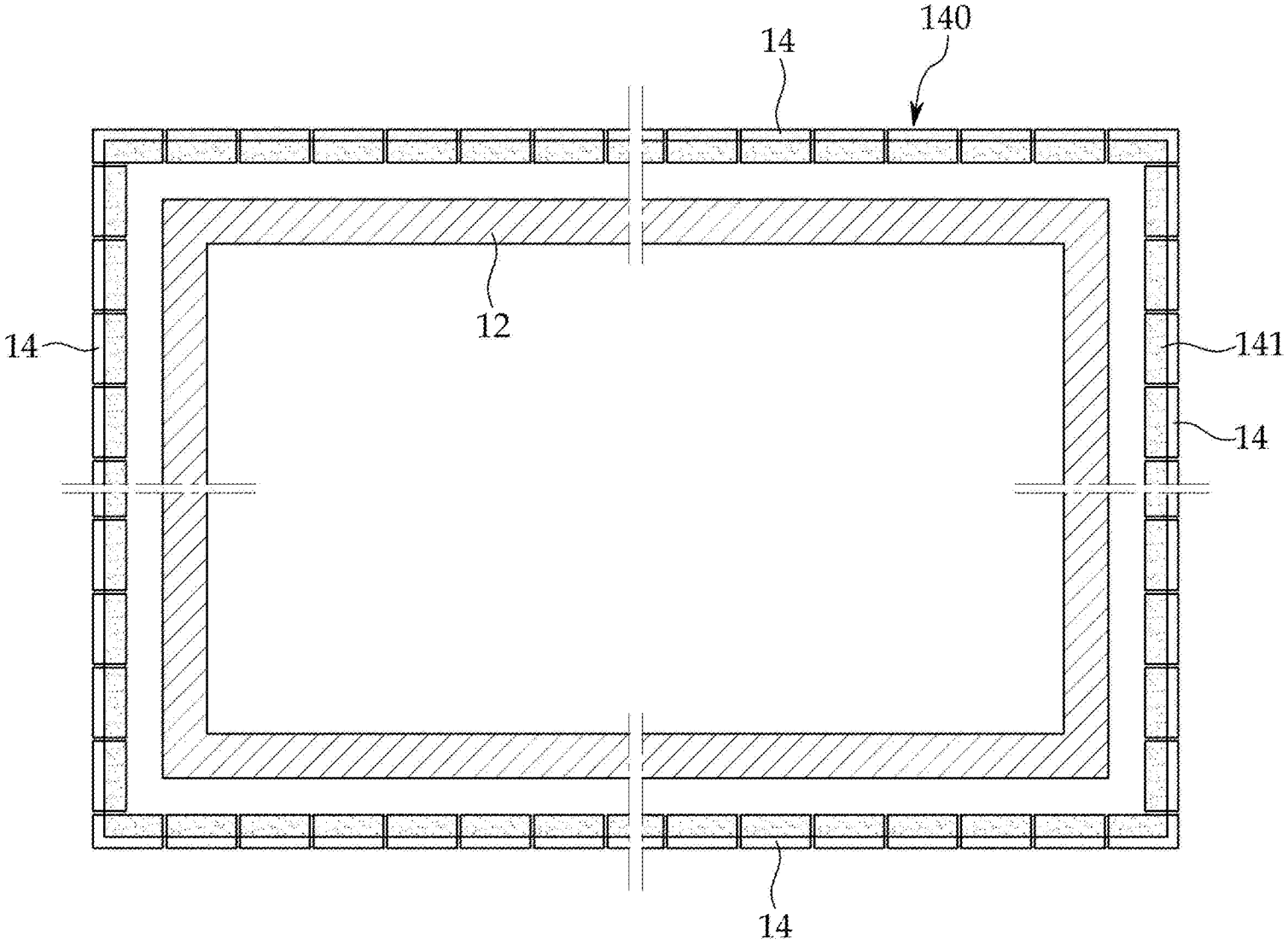
Figure 1C:
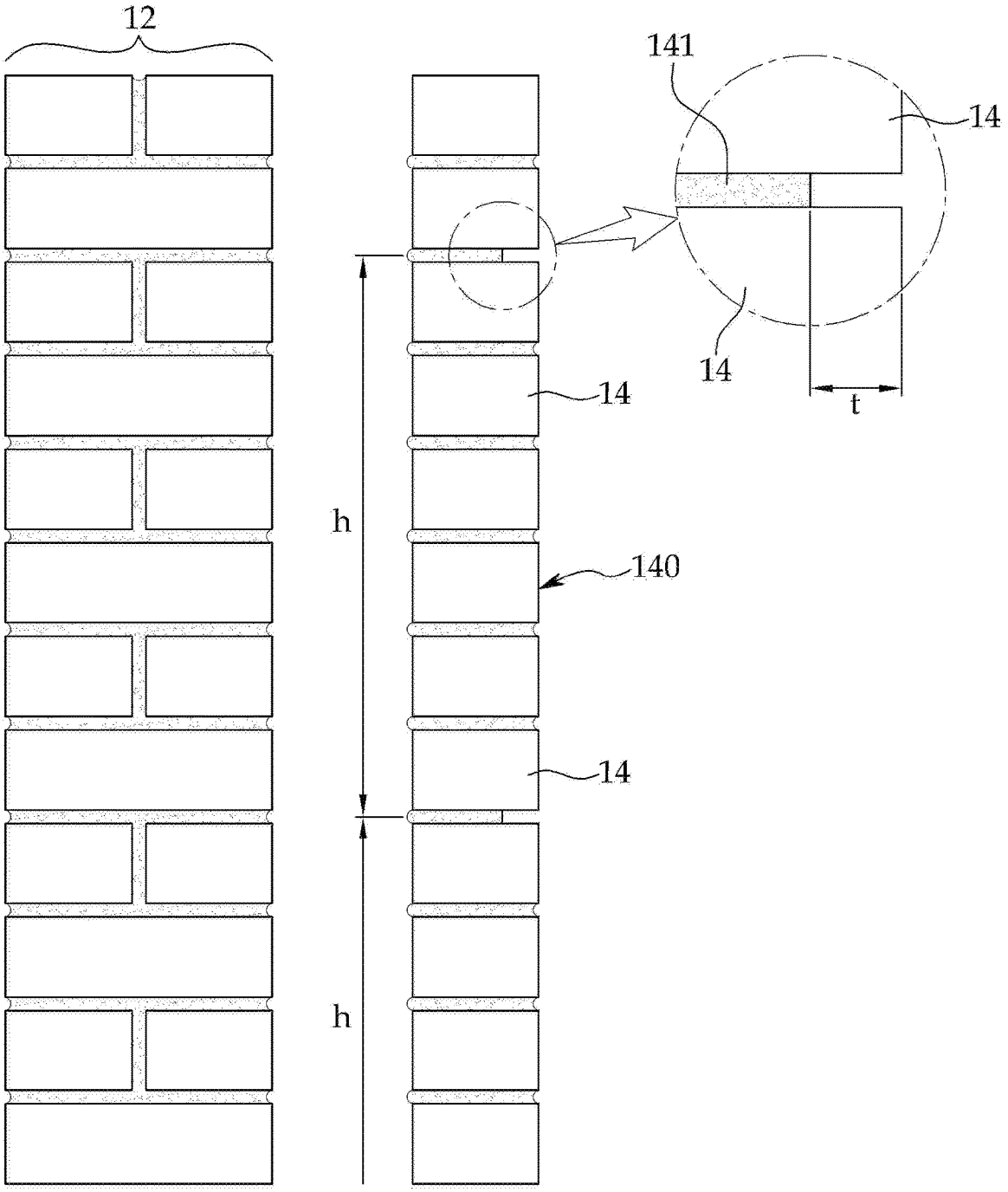
FIG. 1C illustrates a masonry wall replacing a concrete wall illustrated FIG. 1A.

First, as illustrated in FIGS. 1A and 1B, the horizontal joint 141 is selected at every predetermined height h on the outer surface of the masonry structure 140, and is removed by the predetermined depth t along the entire circumference of the masonry structure 140. This is intended to lay the deformed bar 40 in the horizontal joint 141, which is described below. The process of removing a portion of the horizontal joint 141 by the predetermined depth t may be performed by grinding and grooving.

The portion of the horizontal joint 141 is removed by the predetermined depth t from the outside by the process, so space through which the deformed bar 40 is arranged along the entire circumference of the masonry structure 140 is secured.

The Mounting of the Cross Joint 20 and the Deformed Bar 40

Figure 2A:
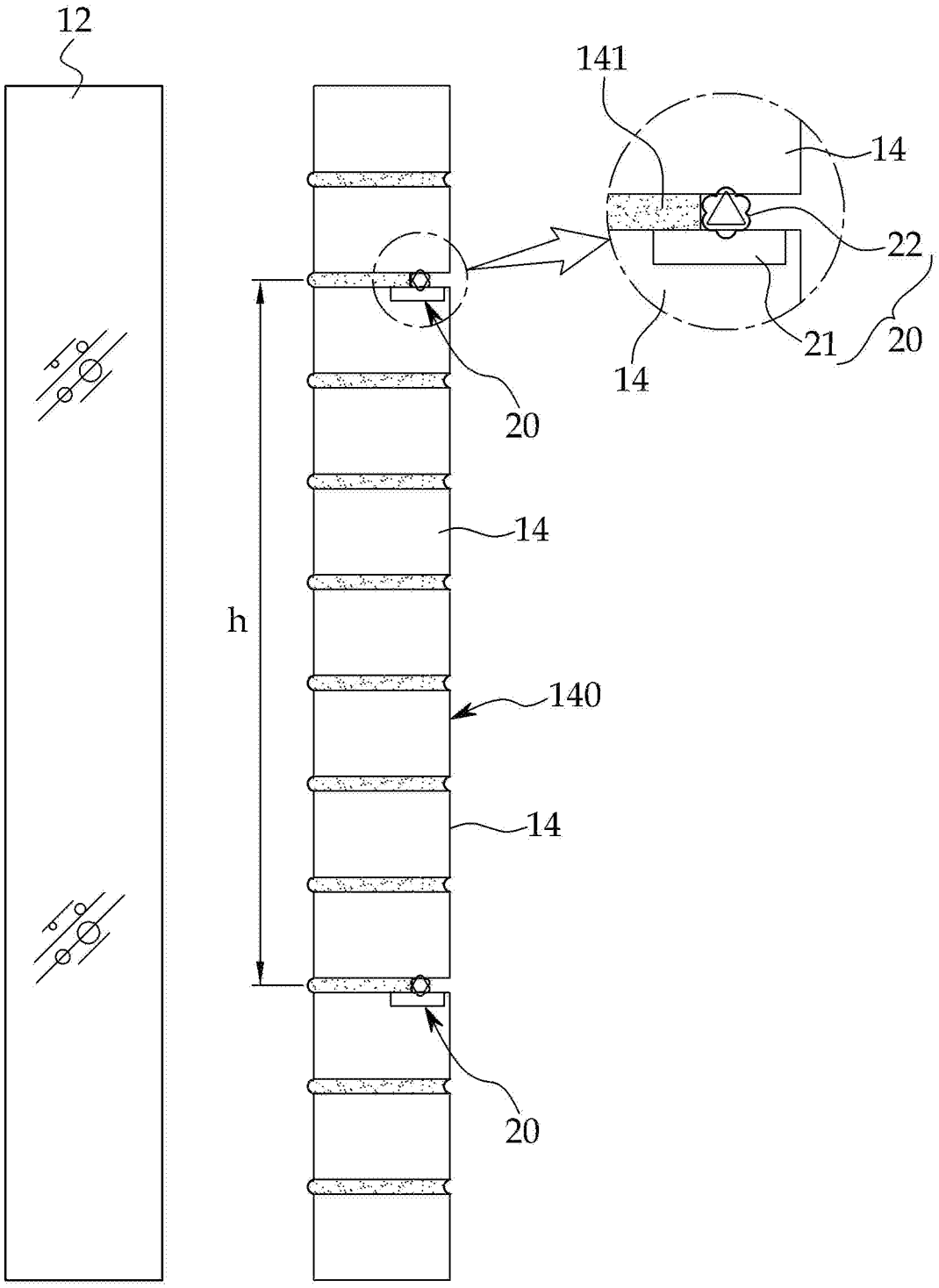
FIGS. 2A and 2B are each a vertical sectional view and a top plan view, respectively, illustrating the state of a cross joint and a deformed bar mounted to the masonry structure.
Figure 2B:
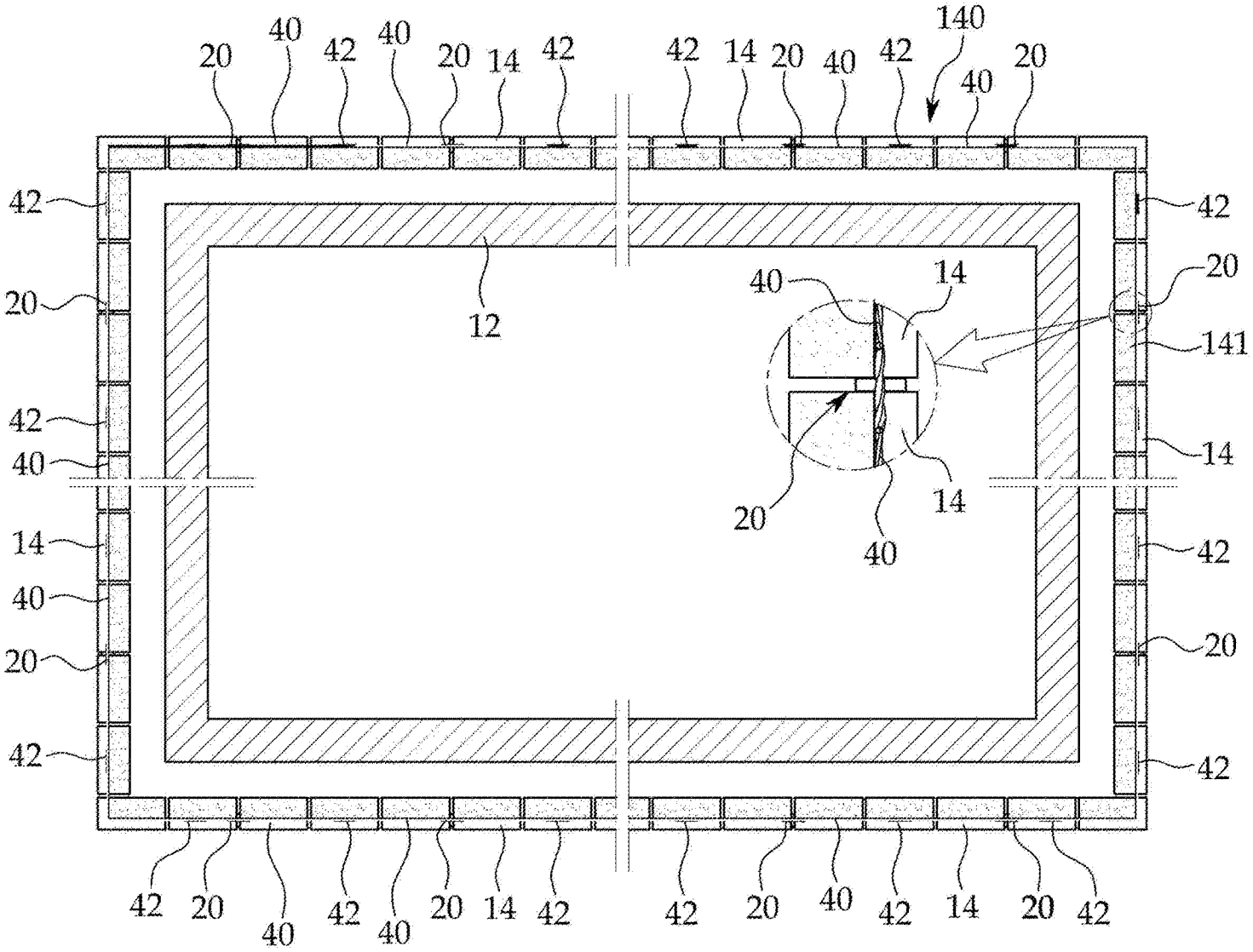

Next, as illustrated in FIGS. 2A and 2B, a vertical joint 142 being in contact with the horizontal joint 141 every predetermined interval along the horizontal joint 141 is selected, and is perforated.

Next, while the deformed bar 40 having a predetermined length is coupled to the horizontal holder 22 of the cross joint 20, the cross joint 20 having the press-in holder 21 and the horizontal holder 22 orthogonal to each other is forcibly fitted to the perforated position. In this case, the press-in holder 21 is press-fitted to each of the perforated holes (not shown), and the horizontal holder 22 and the deformed bar 40 are located in the horizontal joint 141.

Figure 6A:
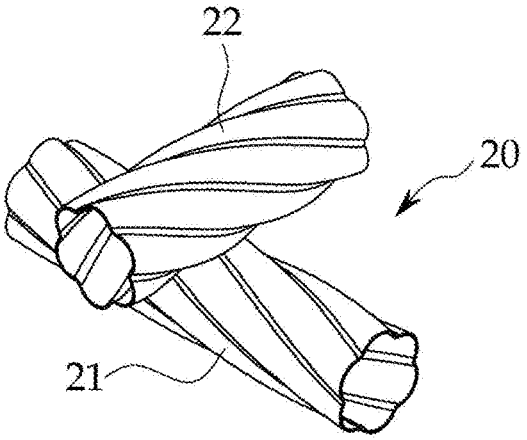
FIGS. 6A, 6B, and 6C are each a perspective view, a front view, and a top plan view, respectively, of the cross joint applied in FIG. 2A.
Figure 6B:
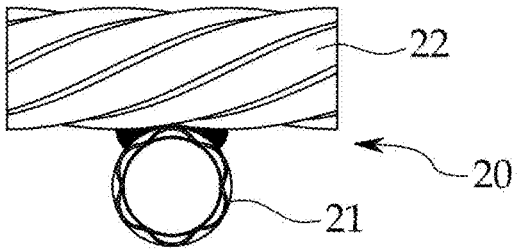
Figure 6C:
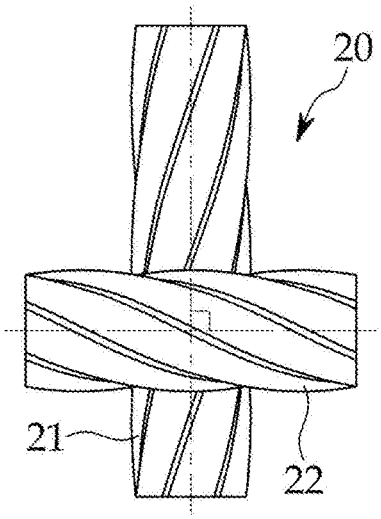
Figure 6D:
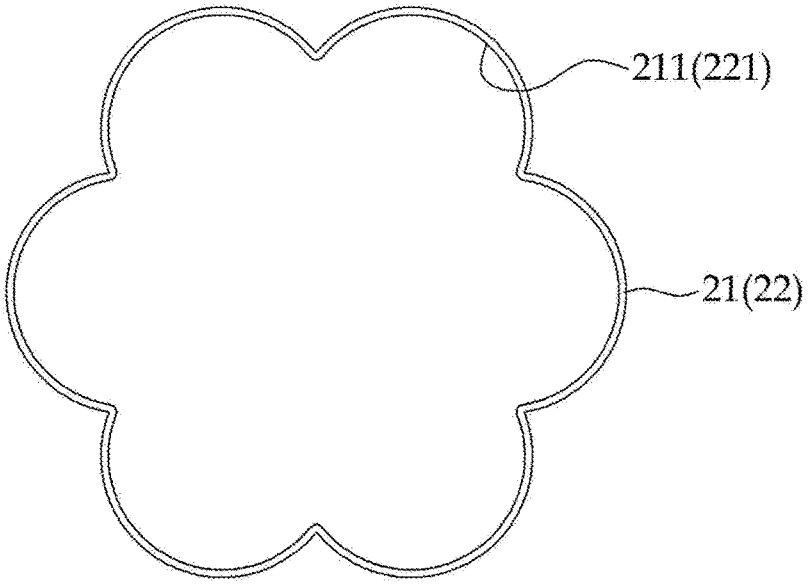
FIG. 6D illustrates the cross-sectional view of a press-in holder and a horizontal holder of the cross joint illustrated in FIG. 6A.

As illustrated in FIG. 6A, 6B, and 6C, the press-in holder 21 of the cross joint 20 has the six spiral grooves 211 provided in the inner circumferential surface thereof so as to receive the spiral wing angles 301 formed on the outer circumferential surface of the deformed bar fixture 30, which is described below, and the horizontal holder 22 has the six spiral grooves 221 formed in the inner circumferential surface thereof. Accordingly, since the press-in holder 21 and the horizontal holder 22 has the spiral grooves 211 and 221, respectively, the deformed bar fixture 30 and the deformed bar 40 are rotatably inserted into the spiral grooves 211 and 221, respectively, to be coupled thereto, and, after the coupling, separation thereof is difficult due to the spiral coupling.

Figure 8A:
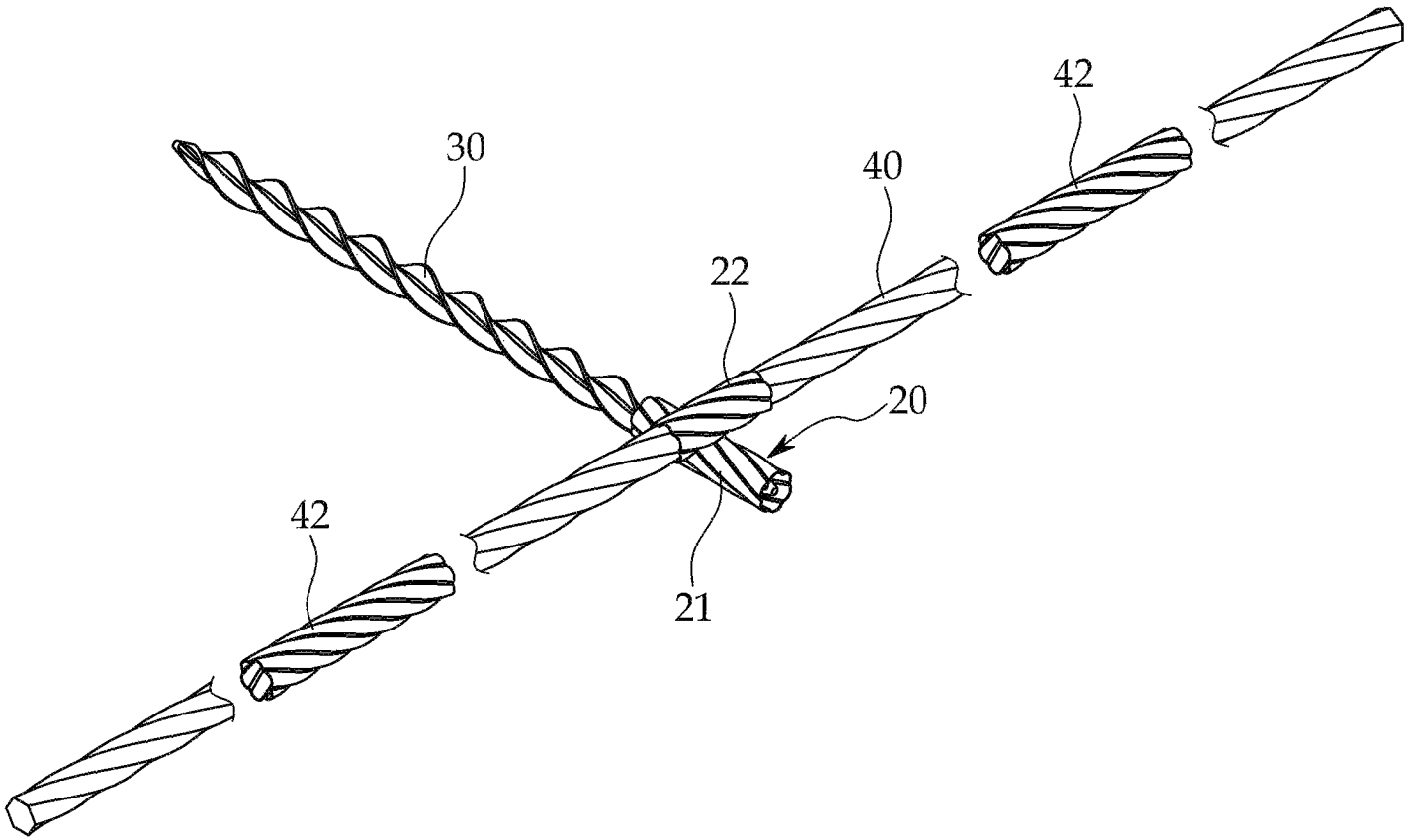
FIG. 8A is the combined perspective view of the cross joint, the deformed bar fixture, and the deformed bar according to the embodiment of the present invention.
Figure 8B:
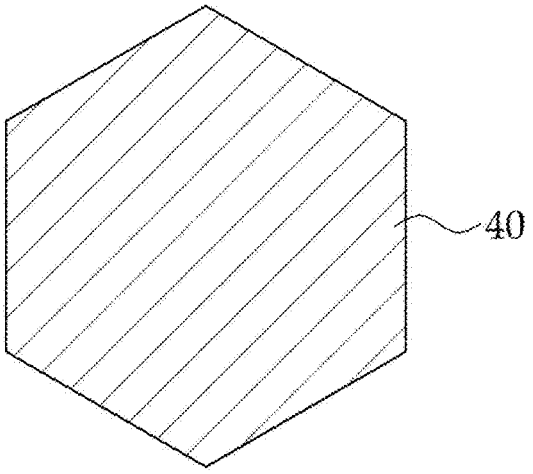
FIGS. 8B and 8C illustrates cross-sectional views of the deformed bar illustrated in FIG. 8A.
Figure 8C:
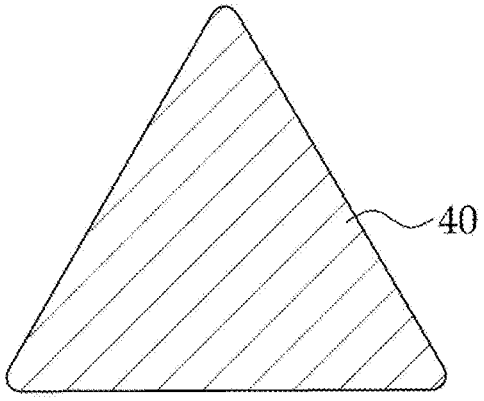
Figure 9:
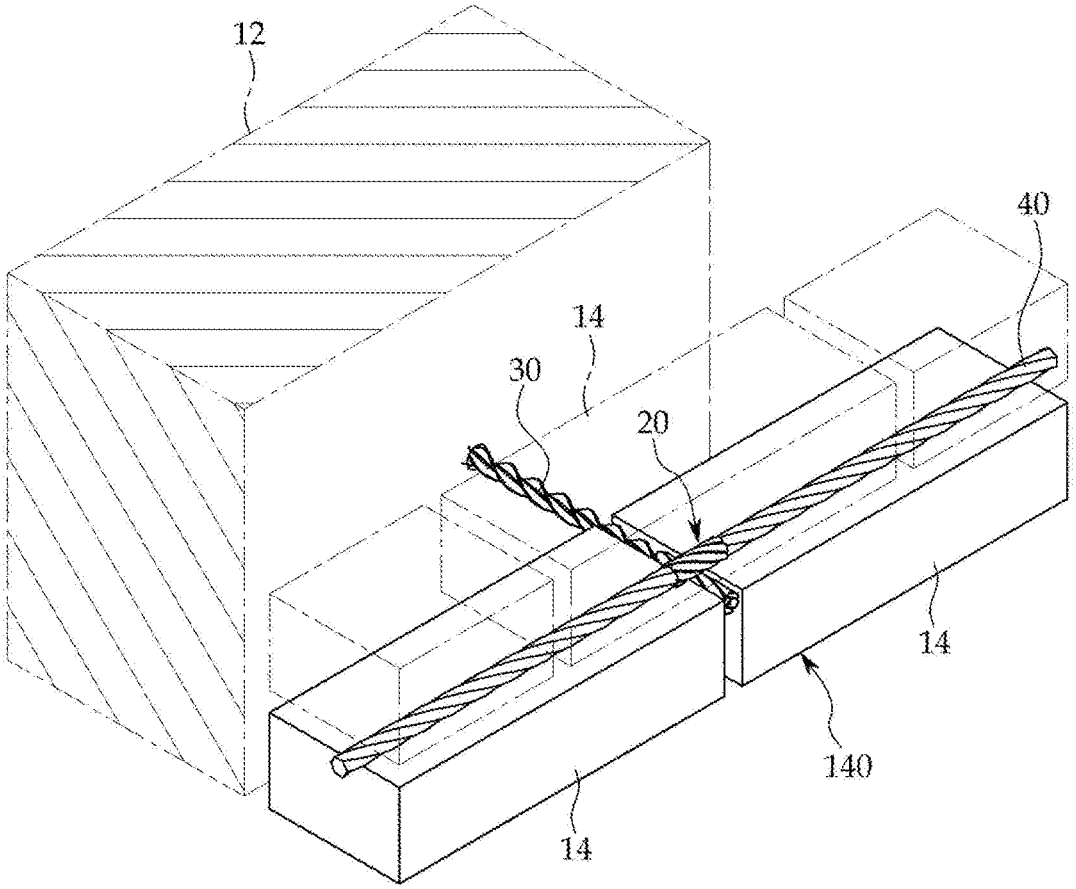
FIG. 9 is a perspective view illustrating an important part of the anti-seismic performance reinforcement structure of the masonry structure according to the embodiment of the present invention.

In this case, the deformed bars 40 and 40 neighboring to each other are installed to have a binding holder 42 connected to each end seam thereof as illustrated in FIGS. 2B and 8A. In this case, the binding holder 42 has a triangular or hexagonal spiral groove structure that receives the spiral cross-section of the deformed bar.

Accordingly, the deformed bars 40 are joined together via the binding holder 42 to surround the entire circumference of the masonry structure 140 in one bundle so that crack repair and the anti-seismic performance reinforcement are performed.

Next, as illustrated in FIG. 4A, after the silicon S2 is coated on the deformed bar 40 to surround the deformed bar 40 at the horizontal joint 141 to which the deformed bar 40 is mounted, non-shrink mortar M is filled thereon to perform a finishing work of the structure.

The Mounting of the Deformed Bar Fixture 30

Figure 3A:
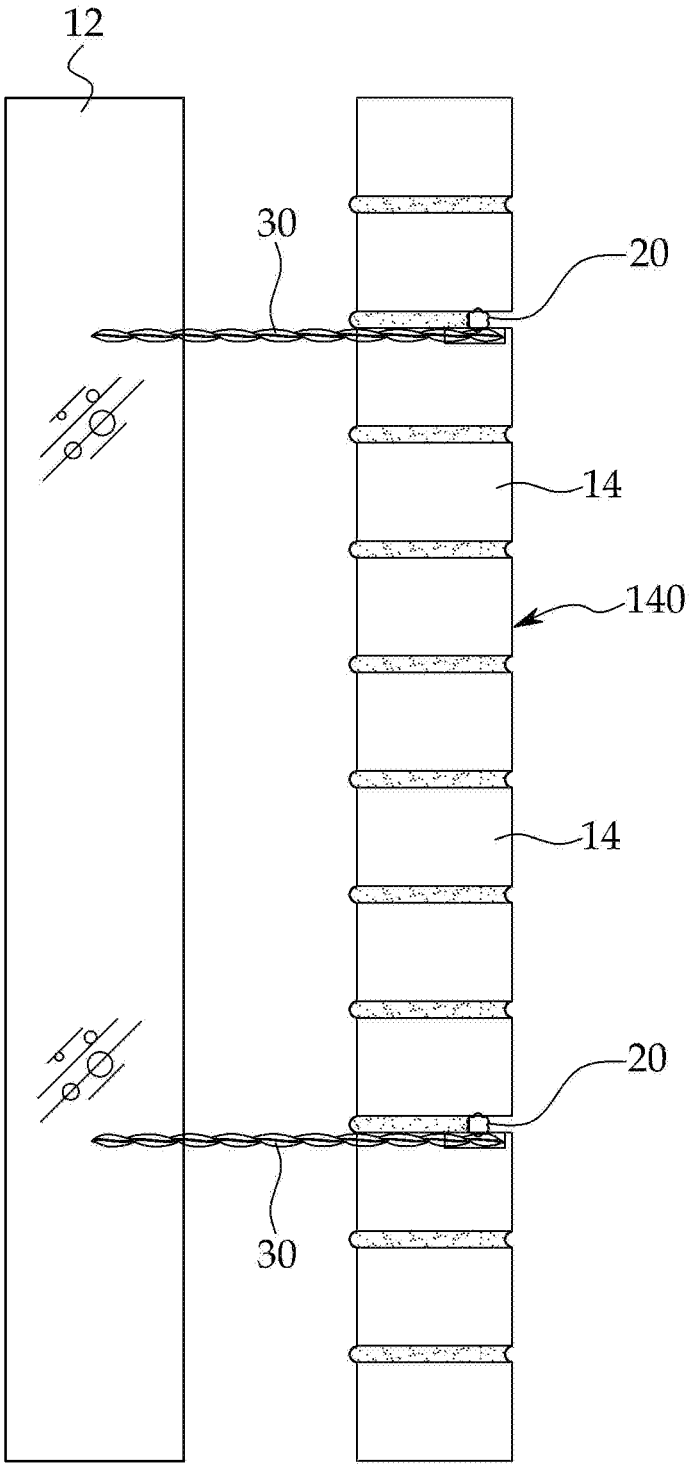
FIGS. 3A and 3B are each a vertical sectional view and a top plan view, respectively, illustrating the state of a deformed bar fixture mounted to the cross joint.
Figure 3B:
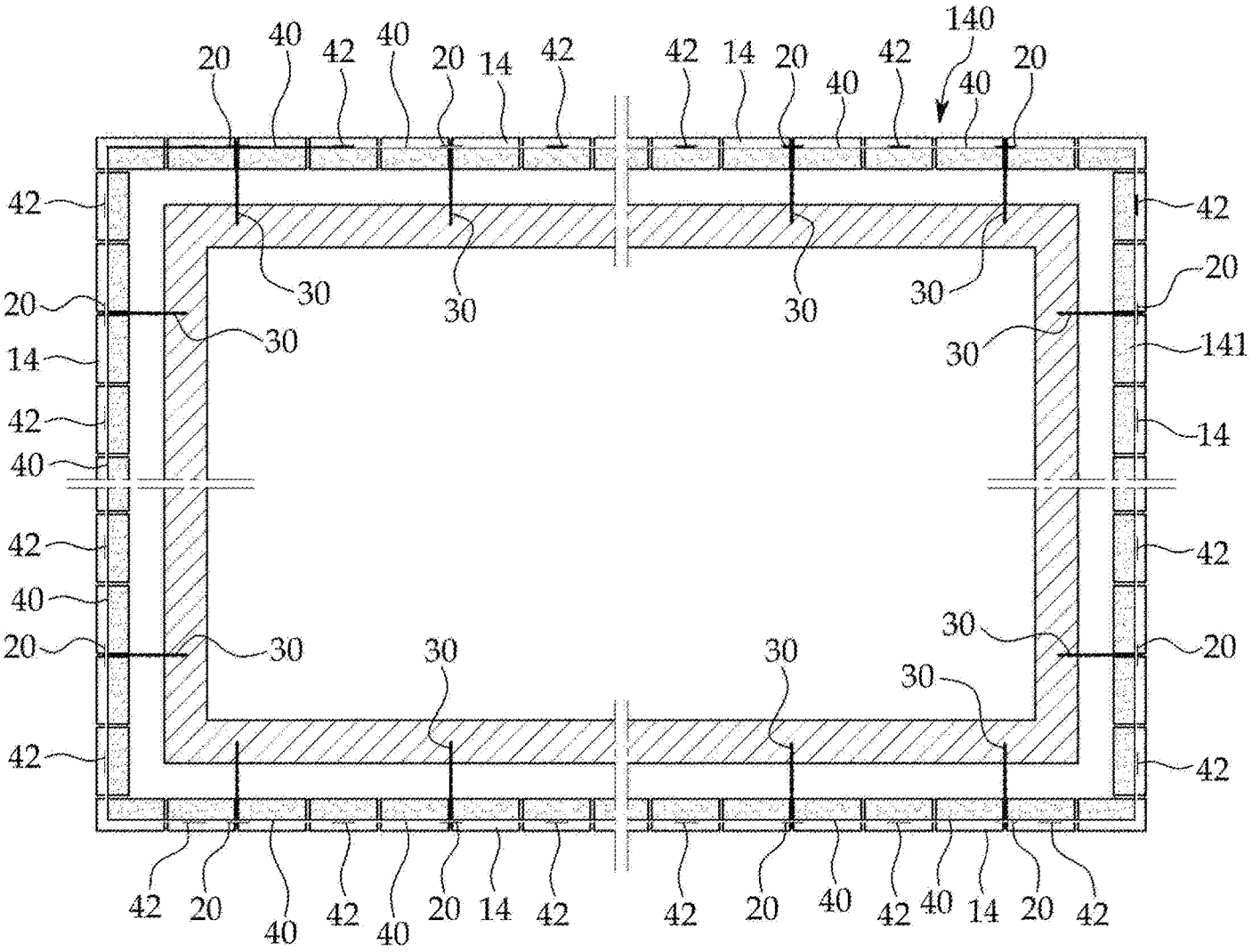

Next, as illustrated in FIGS. 3A and 3B, the deformed bar fixture 30 is rotatably inserted into the press-in holder 21 of the cross joint 20 to be coupled thereto, and the mounting of fixing the deformed bar fixture 30 to the wall 12 by driving the deformed bar fixture 30 thereinto is performed.

In this case, the deformed bar fixture 30 is manufactured as a long steel material having two to six spiral wing angles 301 provided on the outer circumferential surface thereof. The deformed bar fixture 30 is preferably manufactured to have a sharp front end to facilitate rotational penetration thereof.

Next, a gap between the press-in holder 21 and the deformed bar fixture 30 may be filled with the silicon S1. In this case, since the deformed bar fixture 30 has a spiral structure, the gap between the press-in holder 21 and the deformed bar fixture 30 may be filled with a sufficient amount of the silicon S1. In this case, when the wall 12 and the masonry structure 140 are moved integrally to each other during an earthquake, the masonry structure 140 can absorb impact due to the silicon S1.

Meanwhile, in the method of the present invention, before removing the portion of the horizontal joint 141, the middle fixtures 32 may be first mounted as illustrated in FIGS. 4A and 5. In this case, the middle fixtures 32 rotatably penetrates the wall 12 to be fixed thereto by penetrating the masonry bricks 14 at an area between the deformed bar 40 and 40 vertically neighboring to each other. The middle fixture 32 has the same structure as the deformed bar fixture 30.

In this case, as illustrated in FIG. 5, when middle fixtures 32 and 32 vertically neighboring to each other are connected to horizontal deformed bar fixtures 30 and 30 located to be adjacent to each other therebetween by an imaginary line, a rhombus arrangement is preferably defined. When the middle fixtures 32 and 32 vertically neighboring to each other and the horizontal deformed bar fixtures 30 and 30 are arranged in a rhombus shape, a horizontal load is evenly distributed during an earthquake, so an anti-seismic performance can be further improved.

Accordingly, in the method of the present invention, while the masonry structure 140 is connected to the wall 12 by the deformed bar fixtures 30, the deformed bar 40 is mounted to have the configuration of surrounding the entire circumference of the masonry structure 140 by being tied thereto at every predetermined height. Accordingly, during an earthquake, the wall 12 and the masonry structure 140 are integrally moved. Accordingly, the collapse of the masonry structure 140 can be prevented, so the anti-seismic performance is improved. In addition, even when crack 200 occurs in the masonry structure 140 as illustrated in FIG. 10A, the method can be used to achieve crack repair as illustrated in FIG. 10B. During this process, the masonry brick 14 which is cracked is replaced with a new masonry brick.

Although the exemplary embodiment of the present invention has been described for illustrative purposes, those skilled in the art will appreciate that various modifications, additions and substitutions are possible, without departing from the scope and spirit of the invention as disclosed in the accompanying claims. The present invention is not limited by such a modified invention, but is limited by the appended claims.

What is claimed is:

1. A method of performing anti-seismic reinforcement and crack repair of a masonry structure with masonry bricks on an outside of a wall, the method comprising:

removing a predetermined depth of a horizontal joint along an entire circumference of the masonry structure by selecting the horizontal joint at a predetermined height on an outer surface of the masonry structure;

mounting deformed bars such that the deformed bars are in contact with the horizontal joint by forcibly fitting a press-in holder to a perforated hole in the masonry structure while the deformed bars are coupled to a horizontal holder of a cross joint after perforating a vertical joint by selecting the vertical joint being in contact with the horizontal joint at predetermined intervals along the horizontal joint;

fixing a deformed bar fixture to the wall by driving the deformed bar fixture thereto after inserting and coupling the deformed bar fixture to the press-in holder of the cross joint; and tying the entire circumference of the masonry structure after surrounding the entire circumference with the deformed bars.

2. The method of claim 1, further comprising:

mounting middle fixtures fixed to the wall into the masonry bricks by allowing the middle fixtures to penetrate the masonry bricks.

3. The method of claim 2, wherein when the middle fixtures vertically neighboring to each other and horizontal deformed bar fixtures adjacent to each other between the middle fixtures are connected to each other by an imaginary line, the middle fixtures and the deformed bar fixtures are constructed to define a rhombus arrangement.

4. The method of claim 1, wherein in the fixing, the deformed bar fixture has two to six spiral wing angles on an outer circumferential surface thereof;

the press-in holder of the cross joint has six spiral grooves in an inner circumferential surface thereof, the spiral grooves receiving the spiral wing angles provided on the outer circumferential surface of the deformed bar fixture; and the horizontal holder has six spiral grooves in an inner circumferential surface thereof.

5. The method of claim 1, wherein in the fixing, a gap between the press-in holder and the deformed bar fixture is filled with silicon.

6. The method of claim 1, wherein in the tying, non-shrink mortar is filled on a back surface of each of the deformed bars to perform a finishing work.

* * * * *